United States Patent [19]

Seuter et al.

[11] Patent Number: 4,544,997

[45] Date of Patent: Oct. 1, 1985

[54] LOW-PRESSURE MERCURY VAPOR DISCHARGE LAMP

[75] Inventors: Antonius M. J. H. Seuter; Petrus F. J. van den Boom, both of Eindhoven, Netherlands

[73] Assignee: U.S. Philips Corporation, New York, N.Y.

[21] Appl. No.: 506,927

[22] Filed: Jun. 22, 1983

[30] Foreign Application Priority Data

Jul. 9, 1982 [NL] Netherlands ..... 8202778

[51] Int. Cl.[4] ..... F21K 2/00

[52] U.S. Cl. ..... 362/263; 252/301.4 R; 252/301.4 P; 313/483

[58] Field of Search ..... 362/263, 2, 34, 84; 252/301.4 R, 301.4 P, 301.4 F; 313/483, 468, 487

[56] References Cited

U.S. PATENT DOCUMENTS

| | | | |
|---|---|---|---|
| 4,034,257 | 7/1977 | Hoffman | 252/301.4 R |
| 4,038,203 | 7/1977 | Takahashi | 252/301.4 P |
| 4,162,232 | 7/1979 | Yale | 252/301.4 F |

*Primary Examiner*—Donald P. Walsh

*Attorney, Agent, or Firm*—Norman N. Spain

[57] ABSTRACT

A low-pressure mercury vapor discharge lamp comprising a glass discharge envelope (1) in which during operation of the lamp a discharge is present and which contains mercury and a rare gas, at least a part of the inner wall of the discharge envelope being provided with a thin at least substantially homogeneous continuous transparent layer (4) which is resistent to the action of the discharge.

According to the invention, this transparent layer (4) contains an oxide of at least one of the groups comprising yttrium, scandium, lanthanum, gadolinium, ytterbium and lutetium.

8 Claims, 2 Drawing Figures

LOW-PRESSURE MERCURY VAPOR DISCHARGE LAMP

BACKGROUND OF THE INVENTION

The invention relates to a low-pressure mercury vapour discharge lamp comprising a glass discharge envelope in which a discharge is present during operation of the lamp and which contains mercury and a rare gas, at least a part of the inner surface wall of the discharge envelope being provided with a thin at least substantially homogeneous continuous transparent layer, which is resistant to the influence of the discharge.

It is known to take measures in low-pressure mercury vapour discharge lamps to prevent greying of parts of the inner wall of the discharge envelope which are in contact with the discharge. Such a greying, which is due to interaction of mercury and glass, is undersirable and not only gives rise to a reduction of the light output but also results in an unaesthetic appearance of the lamp, in particular due to the fact that the greying occurs irregularly, for example, in the form of dark stains and dots.

It is proposed in the U.S. Pat. No. 3,377,494 to provide the inner wall of the discharge envelope with a thin substantially homogeneous continuous transparent layer of, for example, titanium dioxide or zirconium dioxide in order to prevent greying of the glass inner wall of the discharge envelope.

In contrast to a protective granular layer consisting of a refractory metal oxide (such as aluminum oxide or silicon dioxide) which is composed of a large number of small particles and should be comparatively thick in order to prevent the occurrence of any interaction such a interaction between mercury and the glass wall. However in the lamp according to the aforementioned United States Patent Specification, a direct contact between the glass wall and the mercury discharge is avoided due to the presence of the thin homogeneous continuous transparent layer.

Due to the presence of the transparent layer, according to said Patent Specification, it is sufficient to use in the discharge envelope a comparatively thin luminescent layer, as a result of which a considerable saving in the required quantity of luminescent material is obtained compared with lamps not provided with a transparent protective layer.

It has been found that, especially in a transparent layer containing titanium dioxide, ultraviolet radiation having a wave length of approximately 350 nm is absorbed to a considerable extent; it has further been found that resonance radiation of mercury having a wave length of 354 nm is even absorbed to a substantially complete extent. This is especially disadvantageous when such a layer is employed in lamps which emit substantially exclusively radiation of the this wave length. Examples of such lamps are germicide lamps and lamps emitting ultraviolet radiation of comparatively long wave lengths, such as lamps intended for solarium arrangements.

SUMMARY OF THE INVENTION

The invention has for its object to provide a lamp in which greying and discolouring of the glass wall of the discharge envelope are limited to a minimum, the light or radiation output of the lamp remaining at the highest possible level during lamplife.

According to the invention, a low-pressure mercury vapour discharge lamp of the kind mentioned in the opening paragraph is therefore characterized in that the transparent layer is formed of an oxide of at least one of the elements in the group comprising yttrium, scandium, lanthanum, gadolinium, ytterbium and lutetium.

The aforementioned oxides can be applied in a simple manner as a very thin continuous and homogenous transparent layer to the glass wall of a discharge envelope. This is effected, for example, by rinsing the discharge envelope with a solution of a suitable metallo-organic compound (such as an acetyl acetonate) in an organic solvent, the desired layer being obtained after drying and sintering. Alternatively, the layer may be applied by means of a method, in which a metal compound is introduced into a discharge envelope by means of a carrier gas (such as air) whilst being heated and is deposited on the wall. It has been found that layers of the aforementioned oxides are highly resistant to the action of the mercury and rare gas containing atmosphere in the discharge envelope of a low-pressure mercury vapour discharge lamp. They also satisfy very well the requirements of light or radiation transmission. The oxides according to the invention are selected especially from a plurality of oxides of rare earth metals. Layers provided with oxides of the metals according to the invention are particularly suitable for use in low-pressure mercury discharge lamps because they are colourless and substantially do not exhibit any absorption of useful radiation (such as UV radiation and visible light).

It should be noted that the German Patent Specificaton No. 1,764,126 discloses a low-pressure sodium vapour discharge lamp comprising a discharge envelope, the inner surface of the wall of which is provided with a homogeneous layer which is transparent to sodium light and resistant to sodium vapour and which, according to the said Patent Specification, may consist of one of the oxides of yttrium and/or the rare earth metals. Such a lamp, however, emits light only with a specific wave length in the visible range. Special problems which are due to the action of short-wave ultraviolet radiation on the layer do not occur in this lamp.

It has been found that absorption of the resonance radiation of mercury having a wave length of 254 nm produced in the discharge envelope hardly occurs in the transparent layer in a lamp according to the invention. In low-pressure mercury vapour discharge lamps for irradiation purposes, in which mainly radiation of a wave length of 254 nm is emitted (such as germicide lamps) and in which the inner wall of the discharge envelope is only coated with the transparent layer according to the invention, it has been found that greying and discolouring of the glass wall rarely occurred even after a large number of operating hours of the lamp. The radiation output of the lamp then remained at a high level as compared with known lamps, without a transparent layer.

The invention can also be used advantageously in lamps comprising a tubular discharge envelope, the inner wall of which is provided with a reflecting layer in which a longitudinal slot is formed. In such lamps, a luminescent layer is present at least on the reflecting layer. In a particular embodiment, however, this luminescent layer extends throughout the periphery of the inner wall of the discharge envelope. In these lamps it was a surprise to find that with the use of a transparent layer according to the invention on the glass wall at least at the area of the longitudinal slot a very high light or radiation output was obtained for a long operating time.

The invention can also be used advantageously in lamps, the whole inner wall of which is coated with a luminescent material. The transparent layer is then present between the luminescent layer and the glass wall. The glass wall is then protected in an effective manner from the influence of the discharge. This has proved to be so especially in lamps provided with a curved discharge envelope (for example, a lamp as described in the Dutch Patent Specification No. 80011833, in which the luminescent layer is not continuous at the area of the curved parts of the discharge envelope and in which a comparatively high wall load occurs.

Experiments have shown that during operation of the lamp the light output remained at a high level.

The transparent layer in a low-pressure mercury vapour discharge lamp according to the invention preferably contains an oxide of yttrium and/or gadolinium. Such a layer has a comparatively high transmission coefficient for ultraviolet radiation and visible light. It has further been found that a layer containing these oxides is not very hygroscopic and adheres satisfactorily to the inner wall of a discharge envelope. Moreover, the layer can be applied in a comparatively simple manner (for example, with yttrium acetyl acetonate), which results in a reduction in cost especially in a mass production process for low-pressure mercury vapour discharge lamps.

The invention will be described more fully with reference to the drawing, in which embodiments of a low-pressure mercury vapour discharge lamp according to the invention are shown diagrammatically in longitudinal sectional view are shown by way of example.

DESCRIPTION OF THE PREFERRED EMBODIMENTS

Figure 1:
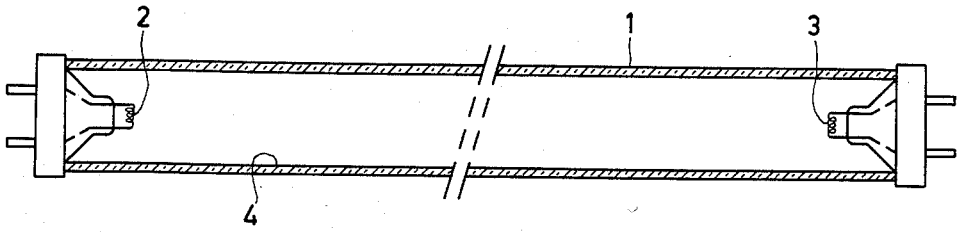
FIG. 1 shows a longitudinal sectional view of a tubular low-pressure mercury vapour discharge lamp, the discharge envelope of which is free from luminescent material.

FIG. 1 shows a low-pressure mercury vapour discharge lamp comprising a tubular discharge envelope 1, at the the ends of which the electrodes 2 and 3 are arranged. During operation of the lamp, a discharge is maintained between these electrodes. The discharge envelope contains mercury vapour and a rare gas, such as argon (pressure approximately 400 Pa). The glass inner wall surface of the discharge envelope is provided with a thin substantially homogeneous continuous transparent layer 4 which is resistent to the influence of the discharge. The lamp shown in the drawing is a lamp for irradiation purposes (a germicide lamp) which mainly emits resonance radiation having a wave length of 254 nm. Such lamps are generally used in a room for destroying undesired bacilli, bacteria and the like as in hospitals. The said transparent layer in practical embodiments of the lamp has a thickness of approximately 5 nm to approximately 200 nm. With a thickness of more than 200 nm, an excessively large absorption takes place of the radiation produced in the discharge envelope. With a layer thickness of less than about 5 nm, interaction nevertheless occurs between the discharge and the glass wall.

A number of experiments have been carried out on lamps (15 W, inner diameter discharge envelope 25 mm, length discharge envelope approximately 50 cm, argon 400 Pa), the discharge envelope of which is provided with a transparent layer containing an oxide according to the invention. The transparent layer was obtained by rinsing the inner wall of the discharge envelope with a liquid containing a metallo-organic compound (for example, yttrium acetyl acetonate) in an organic solvent (for example, ethylene glycol monoethyl ether). The layer is formed after drying and sintering (for example, to approximately 600° C.). The results of the said experiments are shown in the following Table I. The thickness of the oxide layer in all cases was 50 to 150 nm. Table I indicates the radiation output in (UV Watts) as well as (between brackets), the relative radiation output per lamp with respect to 100 operation hours. Table I further indicates the results with a known lamp which is free from a transparent protective layer.

TABLE I

| operating time | lamp: without transparent layer | with $Y_2O_3$ | with $Gd_2O_3$ | with $Sc_2O_3$ |
|---|---|---|---|---|
| 0 h | 4.6W (117%) | 4.6W (107%) | 4.5W (107%) | 4.5Q (110%) |
| 100 h | 3.9W (100%) | 4.3W (100%) | 4.2W (100%) | 4.1W (100%) |
| 1000 h | 3.4W (88%) | 4.1W (95%) | 4.0W (95%) | 3.9W (95%) |
| 2000 h | 2.9W (74%) | 3.9W (90%) | 3.8W (90%) | 3.8W (93%) |

| operating time | lamp: with $La_2O_3$ | with $Yb_2O_3$ | with $Lu_2O_3$ |
|---|---|---|---|
| 0 h | 4.5W (107%) | 4.5W (107%) | 4.5W (107%) |
| 100 h | 4.2W (100%) | 4.2W (100%) | 4.2W (100%) |
| 1000 h | 3.9W (93%) | 4.1W (98%) | 4.0W (95%) |
| 2000 h | 3.7W (88%) | 3.9W (93%) | 3.8W (90%) |

It appears from this Table that the radiation output of lamps according to the invention remains at a high level even after a long operating time. In the lamps according to the invention, attack of the glass wall by the mercury and as a result decrease of the radiation output substantially do not occur.

Figure 2:
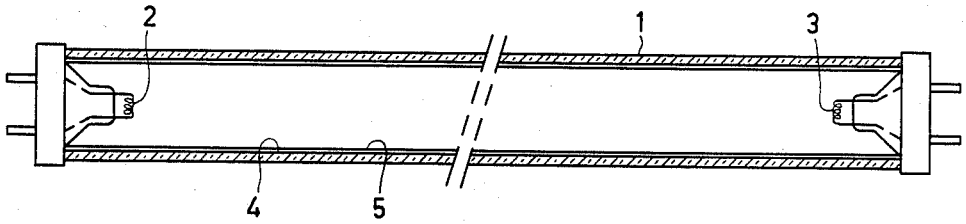
FIG. 2 shows such a lamp, in which the inner wall of the discharge envelope is provided not only with a transparent layer but also with a luminescent layer.

The lamp shown in FIG. 2 likewise comprises a tubular discharge envelope 1, electrodes 2 and 3 and a transparent layer 4. This layer is provided on its side facing the discharge with a layer of luminescent material 5. This layer extends throughout the surface of the transparent layer. In a number of experiments, this luminescent layer 5 consisted of a mixture of three phosphors, i.e. green luminescent terbium-activated cerium magnesium aluminate, blue luminescent barium magnesium aluminate activated with bivalent europium and red luminescent yttrium oxide activated with trivalent europium. In the presence of a transparent layer according to the invention between the said luminescent layer 5 and the glass wall of the discharge envelope, it was a surprise to find that with a small powder weight of the luminescent material (as compared with lamps without a transparent layer) only a small reduction of the light output occurs. The powder weight is to be understood herein to mean the overall weight of the luminescent material in the whole discharge envelope. As compared with the known lamp (without a transparent layer), it has proved possible to limit in the lamps according to the invention the powder weight of the said luminescent material by approximately 25% to approximately 2 mg/cm$^2$, while a reduction of the light output substantially did not occur.

Experiments have been carried out on a number of low-pressure mercury vapour discharge lamps (power 36 W, length 1.20 m, inner diameter 25 mm, argon 400 Pa) provided with a transparent layer consisting of yttrium oxide and with a luminescent layer 5 consisting of a mixture of the aforementioned phosphors. Of the lamps, the light output (lumen) has been measured and compared with the light output of a known lamp having the same dimensions, the same power and a luminescent layer composed of the same phosphors, the latter lamp, however, not being provided with a transparent layer. The results of the experiments are indicated in Table II. The experiments have been carried out on lamps of different powder weights (i.e. with 2.8 g and 2.1 g, respectively, of luminescent material. The results are indicated in the second and the third column (2.8 g) and in the fourth and the fifth column (2.1 g).

TABLE II

| | lamp | | | |
|---|---|---|---|---|
| operating time | without transparent layer 2.8 gr. Lum. mat. | with $Y_2O_3$ transparent layer 2.8 gr. Lum. mat. | without transparent layer 2.1 gr. Lum. mat. | with $Y_2O_3$ transparent layer 2.1 gr. Lum. mat. |
| 0 h | 3460 Lm | 3460 Lm | 3405 Lm | 3435 Lm |
| 100 h | 3410 Lm | 3440 Lm | 3370 Lm | 3410 Lm |
| 1000 h | 3380 Lm | 3410 Lm | 3290 Lm | 3380 Lm |
| 2000 h | 3310 Lm | 3380 Lm | 3245 Lm | 3370 Lm |

It appears from this table that the light output of a lamp according to the inventon is high even after a large number of operating hours. It further appears from the table that, even with a small powder weight (3.5 mg/cm$^2$) the light output of the lamp provided with the transparent layer of $Y_2O_3$ is comparatively high for a long operating time.

Furthermore, experiments have been carried out on a plurality of lamps (15 W, inner diameter discharge envelope 25 mm, length 50 cm, argon pressure 400 Pa), in which only a transparent layer comprising yttrium oxide was present on the inner wall of the discharge envelope. For a number of layer thicknesses, the measured radiation output (UV-Watt, 2000 operating hours) is indicated in Table III.

TABLE III

| layer thickness (nm) | radiation output (UV-Watt) |
|---|---|
| 0 | 3.91 |
| 8 | 5.17 |

TABLE III-continued

| layer thickness (nm) | radiation output (UV-Watt) |
|---|---|
| 20 | 5.11 |
| 40 | 5.27 |
| 80 | 5.22 |

It appears from this table that the radiation output of the lamps provided with a transparent layer comprising yttrium oxide having a thickness of more than 8 nm was considerably higher than for lamps without a transparent layer. The comparatively low radiation output of the lamp without an $Y_2O_3$ layer was due to the occurrence of greying of the wall of the discharge envelope.

We claim:

1. A low-pressure mercury vapour discharge lamp comprising a glass discharge envelope containing mercury and a rare gas and in which during operation of the lamp a discharge is present and which contains mercury and a rare gas, characterized in that at least a part of the inner surface of the wall of the discharge envelope is provided with a thin, at least substantially homogeneous, continuous layer, resistant to the influence of the discharge, transparent to light and radiation from said discharge, and consisting essentially of an oxide consisting of oxygen and at least one of the elements selected from the group consisting of yttrium, scandium, lanthanum, gadolinium, ytterbium and lutetium.

2. A low-pressure mercury vapour discharge lamp as claimed in claim 1, characterized in that the transparent layer contains an oxide of yttrium and/or gadolinium.

3. A low-pressure mercury vapour discharge lamp as claimed in claim 1 characterized in that the thickness of the transparent layer lies between about 5 and 200 nm.

4. A low-pressure mercury vapour discharge lamp as claimed in claim 1 characterized in that the transparent layer is provided on its side facing the discharge with a layer of luminescent material.

5. A low-pressure mercury vapour discharge lamp as claimed in claim 4, characterized in that the luminescent material consists of a mixture of green luminescing terbium activated cerium magnesium aluminate, blue luminescing barium magnesium aluminate activated with bivalent europium and red luminescing yttrium oxide activated with trivalent europium, the powder weight of the luminescent material amounting to approximately 3,5 mg/cm$^2$.

6. A low-pressure mercury vapour discharge lamp as claimed in claim 2, characterized in that the thickness of the transparent layer lies between about 5 and 200 nm.

7. A low-pressure mercury vapour discharge lamp as claimed in claim 2, characterized in that the transparent layer is provided on its side facing the discharge with a layer of luminescent material.

8. A low-pessure mercury vapour discharge lamp as claimed in claim 3, characterized in that the transparent layer is provided on its side facing the discharge with a layer of luminescent material.

* * * * *

UNITED STATES PATENT AND TRADEMARK OFFICE

CERTIFICATE OF CORRECTION

PATENT NO. : 4,544,997

DATED : October 1, 1985

INVENTOR(S) : ANTONIUS M.J.H.SEUTER ET AL

It is certified that error appears in the above-identified patent and that said Letters Patent is hereby corrected as shown below:

IN THE ABSTRACT:

line 10, change "groups" to --elements--.

IN THE CLAIMS:

Claim 1, lines 4 and 5, delete "and which contains mercury and a rare gas,".

Signed and Sealed this

Seventeenth Day of March, 1987

*Attest:*

DONALD J. QUIGG

*Attesting Officer*

*Commissioner of Patents and Trademarks*